US005831199A

United States Patent [19]

McNulty, Jr. et al.

[11] Patent Number: 5,831,199

[45] Date of Patent: Nov. 3, 1998

[54] WEAPON FOR IMMOBILIZATION AND CAPTURE

[75] Inventors: James McNulty, Jr., 1290 3rd St., Calimesa, Calif. 92320; John F. Chudy, II, Yucaipa, Calif.

[73] Assignee: James McNulty, Jr., Calimesa, Calif.

[21] Appl. No.: 865,096

[22] Filed: May 29, 1997

[51] Int. Cl.[6] ..... B64D 1/04; F42B 8/00

[52] U.S. Cl. ..... 89/1.11; 102/502; 361/232

[58] Field of Search ..... 89/1.11; 42/84; 102/501, 502, 504, 293; 361/232, 235

[56] References Cited

U.S. PATENT DOCUMENTS

| | | | |
|---|---|---|---|
| 3,523,538 | 8/1970 | Shimizu | 89/1.11 |
| 3,803,463 | 4/1974 | Cover | 89/1.11 |
| 4,253,132 | 2/1981 | Cover | 361/232 |
| 5,078,117 | 1/1992 | Cover | 102/440 |
| 5,473,501 | 12/1995 | Claypool | 89/1.11 |
| 5,654,867 | 8/1997 | Murray | 361/232 |
| 5,698,815 | 12/1997 | Ragner | 102/502 |

*Primary Examiner*—Charles Jordan
*Assistant Examiner*—Theresa M. Wesson
*Attorney, Agent, or Firm*—Leonard Tachner

[57] ABSTRACT

An immobilization weapon of the type which imparts an electrical voltage across a live target using a projectile launched toward the target from a distance, employs a projectile having two connecters. One such connecter extends from the projectile in fixed relation thereto. The other such connecter is launched from the projectile at or near the target to assure proper spacing between the connecters irrespective of the distance to the target. In the preferred embodiment, the secondarily launched connecter is actuated by current through the target when the projectile is in proximity to the impact surface of the target.

23 Claims, 5 Drawing Sheets

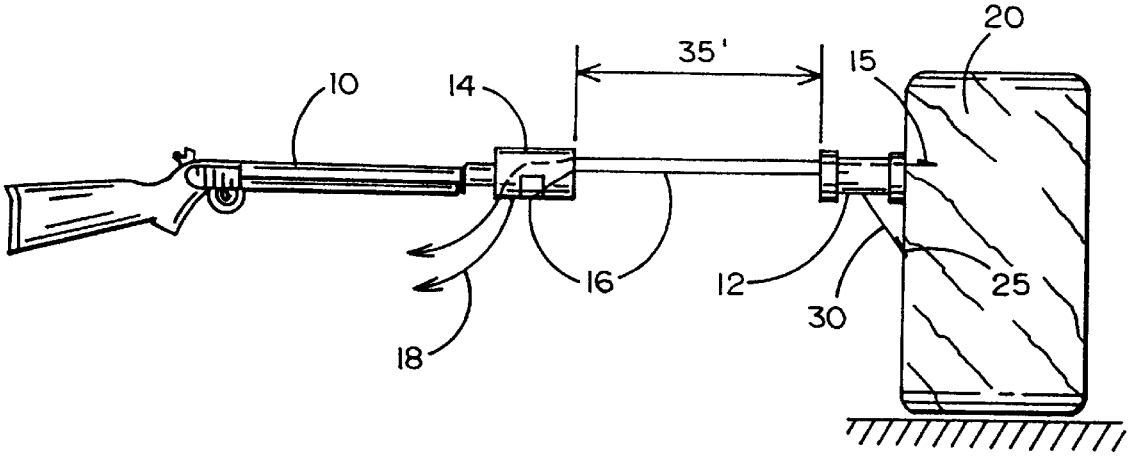
FIG. 1
FIG. 2
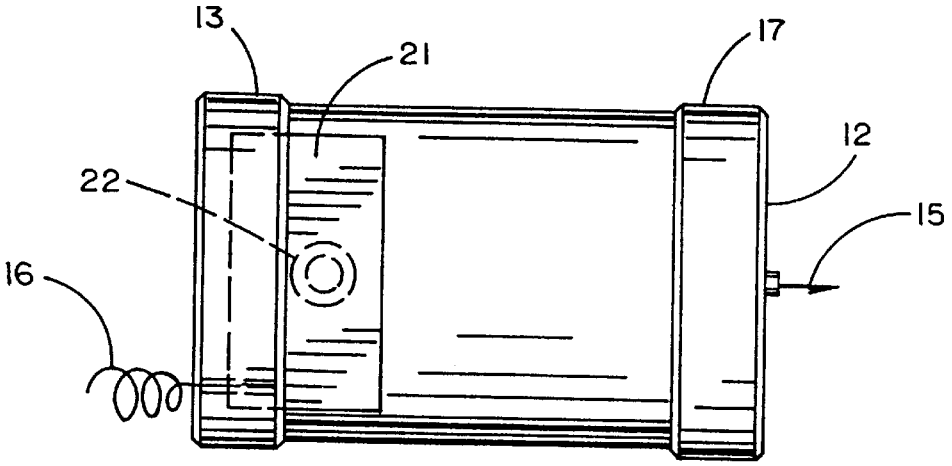

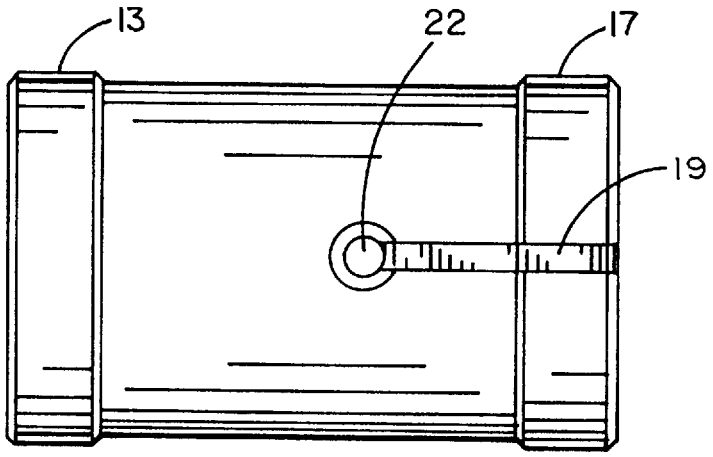
FIG. 3
FIG. 4
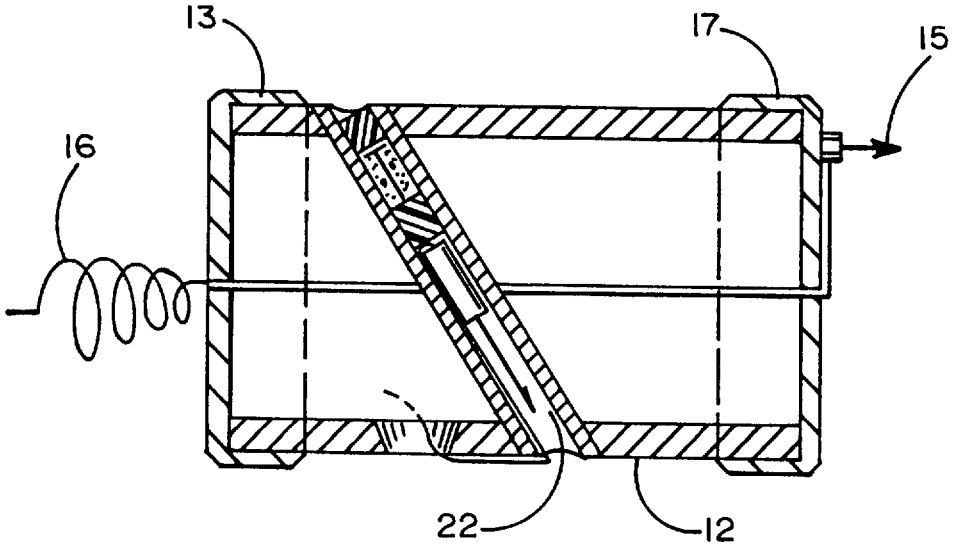

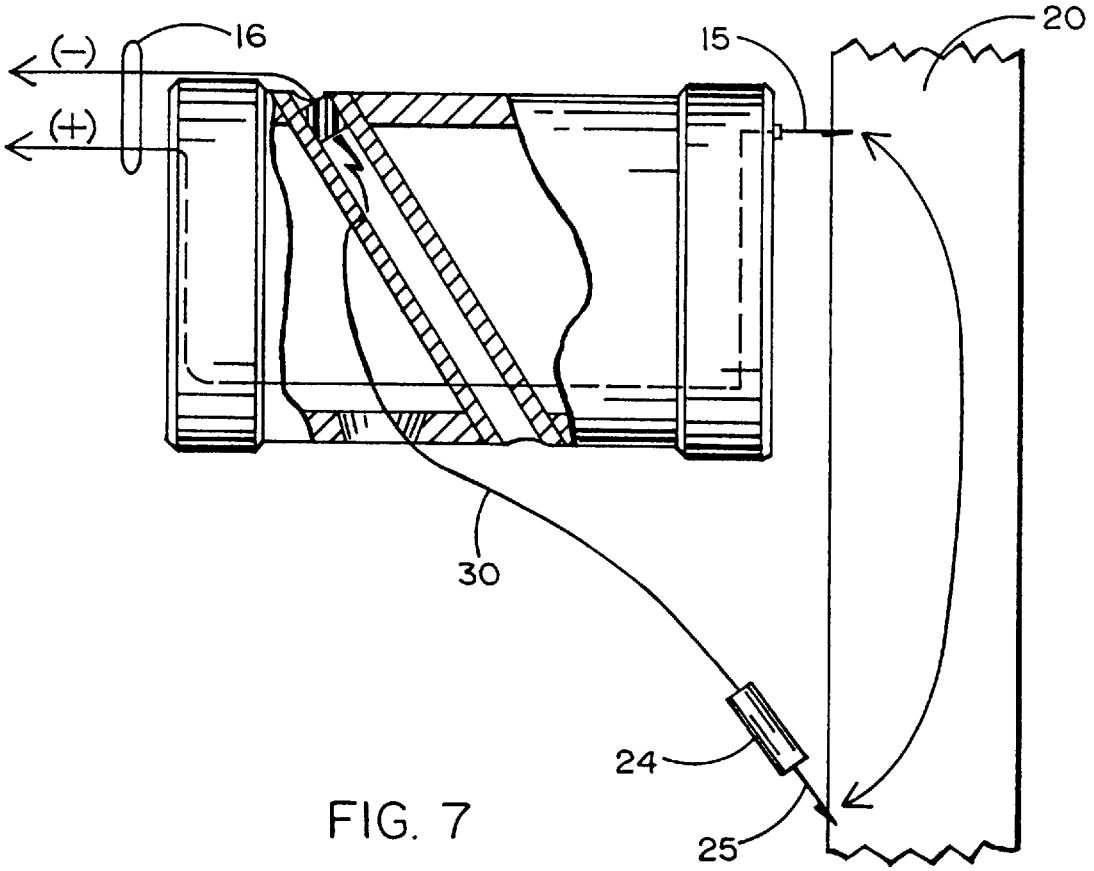
FIG. 7
FIG. 9
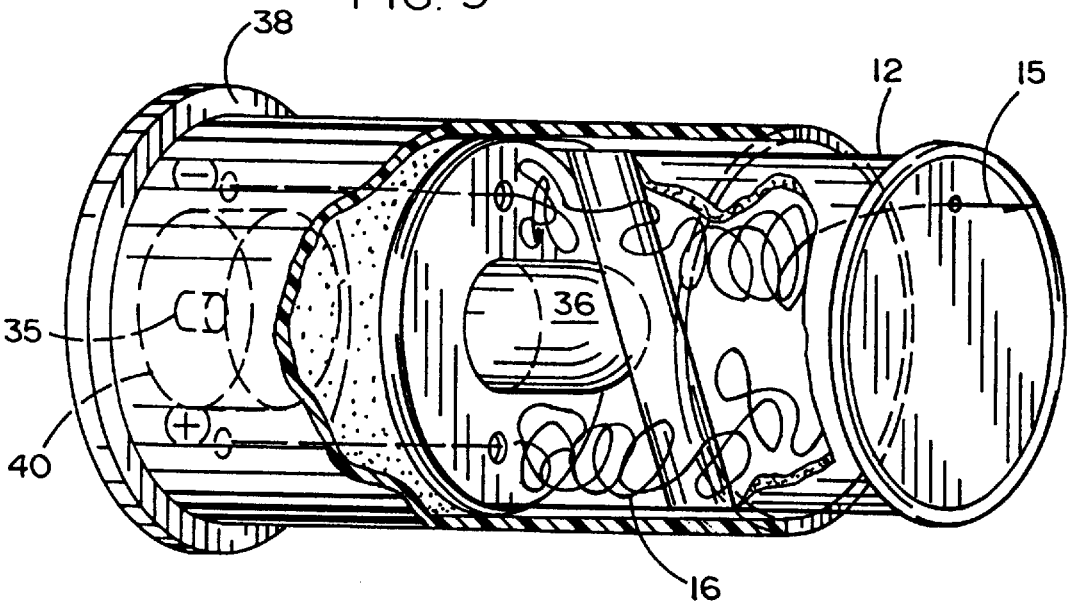

WEAPON FOR IMMOBILIZATION AND CAPTURE

BACKGROUND OF THE INVENTION

1. Field of the Invention

This invention relates generally to the field of non-lethal weapons for immobilizing a live target for capture and more specifically to such a weapon having a projectile and configured for long distance usage preferably from a shotgun or otherwise lethal weapon and having wires tethered to a high voltage source and a pair of connecters for applying the voltage across the target, the distance between the connecters on the target being substantially constant irrespective of distance to the target.

2. Prior Art

The TASER®, a trademark for a weapon for immobilization and capture, is a weapon which outputs electrical power pulses to incapacitate human assailants and which has a lower lethality than conventional firearms. Beginning in the late 1970's, law enforcement agencies began to employ the TASER as a firearm substitute in certain confrontation situations, which could otherwise have justified the use of deadly force. For example, against knife wielding assailants at close range. These agencies have also employed the TASER successfully to avoid injury to both peace officers, assailants, and innocent bystanders in situations where the use of conventional firearms would have been either impractical or unjustified. The TASER's characteristic near instantaneous incapacitating power has been employed to disable an assailant holding jagged glass to a hostage's throat without any physical injury occurring to the hostage, to prevent a raging parent from hurling his infant from a high rise, to prevent a suicidal man from leaping from a high rise, to subdue unarmed combatants without serious physical injury to the peace officer or assailant, without heartbreak to family and friends, and less importantly, without the expense to the community of medical treatment, lost time, and or the permanent disability of previously productive community members. Moreover, unlike conventional firearms, the TASER can be used to thwart air highjackings without the risk of an errantly discharged projectile depressurizing the cabin.

However, because of the limits of materials engineering, the TASER has had significant reliability problems throughout its some 20 years of manufacture and weapon failures have lead to disastrous results. One major problem with the TASER weapon, has been the TASER's limited range. The TASER range as manufactured to date has been between a minimum of 3 feet to a maximum of 15 feet with an effective range of 3 to 12 feet. This has confined the TASER's use to very limited, special, and well defined tactical situations. Society, obviously, would reap enormous benefit from a TASER capable of broader application in confrontational situations. A second TASER problem, is the tendency for the insulation on the weapon delivery wire to rupture under the stress of the TASER output current.

U.S. Pat. No. 3,803,463, issued to John H. Cover on Apr. 9, 1974, describes a weapon for immobilization and capture consisting of means for connecting a power supply, capable of delivering an electrical current sufficient to immobilize but lower than the threshold current required to induce ventricular fibrillation in a normally healthy person, to a remote target by means of an otherwise harmless projectile (s) and trailing wire(s). This invention has been marketed as the TASER® weapon (U.S. Pat. No. 4,253,132 subsequently issued to John Cover on Feb. 24, 1981,) describes various high tension power supplies, which can be used in this weapon when subduing human targets. A human target can be incapacitated with much lower voltages. See *Underwriters Laboratory Research Bulletin No.* 14, December, 1939, and the journal article *Let-Go Currents and Voltages* by C. F. Dalziel and F. P. Massoglia, reprinted from Applications and Industry, published by American Institute of Electrical Engineers, May, 1956. However, as stated in the patents, it is desirable to have a high voltage output which can arc through atmosphere and, thereby, overcome impedances and resistances between the projectile contact and the target without the low velocity projectile/electrical contact, which is presumed incapable of seriously injuring the target, actually penetrating or contacting the target. For example, if one projectile were to embed in the lapel of a human target's shirt, an atmosphere arcing current of adequate length might still complete the circuit. With the thick outer garments often worn in colder climates in winter, a minimum output arc of 1½" the target is highly desirable. John Cover was subsequently issued U.S. Pat. No. 5,078,117, which describes a device for propelling a projectile by release of a volume of compressed gas from a container ruptured by a pyrotechnic detonation and which has been adapted for use with the weapon for immobilization and capture described in U.S. Pat. No. 3,803,463.

While the patents describe a single conductor wire connection system for delivering the supply output to the target with a ground return completing the circuit, this single conductor wire system was impractical for generally subduing human targets considering the high electrical resistivity of such paving materials as asphalt and flooring materials as ceramic tile and wood and has not been manufactured to date except as an experimental model intended to capture large mammals in open fields. See *An Electronic Means Of Immobilizing Deer* by D. A. Jessup, D. V. M., and W. E. Clark, B. A., available through the state of California, Department of Fish and Game. And, while the single conductor wire system described in the patents for capacitively charging the target is theoretically possible, its development has not been attempted because of impracticality. Accordingly, the weapon has only been developed and produced with a delivery system consisting of a single conductor wire connecting one of the supply's two poles to the target and a separate single conductor wire connecting the supply's opposing pole to the target and completing the electrical circuit, that is, a paired wire delivery system where in each wire contains a single conductor.

Field data suggests that if weapons for immobilization and capture are manufactured with a paired wire delivery system wherein each wire contains a single conductor, and such weapons are to have any chance of being reliably effective, an electrical path of at least several inches through a human target and between the weapon's projectile contacts and affixes to the target is highly desirable. It is not just the supply output, but the supply output coupled with an adequate path within the target that results in an effective weapon for immobilization and capture. Both the distance of the electrical path, the time of application, and the particular area of the anatomy traversed by the current, are factors which contribute to the weapon's efficacy.

The TASER was originally conceived as a hand held and potentially concealable device. One purpose for the TASER was to create an easily concealable weapon of light weight, which could be employed to thwart aircraft highjackings without risk of a weapon projectile penetrating and depressurizing the craft with the ensuing catastrophic consequences. Accordingly, as a practical matter, the electrically opposing projectiles with their trailing wires could not be adequately spaced apart from each other upon leaving the launching portion of the weapon. The weapon's developers, therefore, designed the weapon so the two projectiles and their trailing wires would continuously spread apart from each other while in flight between the weapons launching device and the target.

As manufactured to date, the TASERS contain in their plastic casings, one or more ports into which a cartridge is inserted. When switched on, the TASER releases a propellant, expelling from the bores in the cartridge two electrically conductive darts whose trailing conductive wires are attached to the device's electrical power supply. The darts depart the cassette through separate exit bores which have diameters of 6 mm and which are spaced approximately 6 mm apart from each other. One exit bore is positioned along the horizontal plane of the launcher. The second exit bore is in a position spaced vertically from the first bore and propels a dart at an acute angle relative to the other dart. As the darts leave their respective bores, they continuously spread an increasing distance from each other as they approach the target. When both darts strike the human target, high voltage, low amperage, and low power electrical pulses of brief period, pass through the target between the darts and as the result of the electrical current's physiological effect upon the skeletal muscle and/or pain compliance, the target experiences an apparent temporary ambulatory incapacitation.

This method of allowing the darts to continuously spread apart from each other from the time they exit the launching portion of the TASER and during their flight toward the target, has a number of drawbacks. First, it greatly limits the TASER's range. Both minimum and maximum range are sacrificed. Depending on the angle between the bores, the darts will not spread enough at closer ranges to insure an adequately large current path through the target, unless the marksman is lucky enough to impact a particularly sensitive area of the body. At further ranges the darts will have spread too far apart for both of them to impact the target as needed to complete the current path through the target. For example, TASERs as manufactured to date, have a fifteen degree angle between their exit bores. For every five feet the darts travel toward the target, the darts will spread approximately 1.3 feet further apart. This likely limits the devices effective minimum range to three feet away from the target and its effective maximum range to 15 feet from the target. At a distance of fifteen (15) feet, the darts are spread approximately 3.9 feet apart and would not likely both embed in a human or small animal target to complete the circuit. The TASER's best operational range is from 3 to 12 feet. Hence, the TASER as developed and manufactured has limited tactical application.

Second, with the angle between the darts as stated, if the individual deploying the TASER even slightly cocks or angles the weapon when discharging it, the dart exiting the angled bore will likely angle off horizontally and miss the target completely leaving the circuit path ineffectively open and standing a chance of the misdirected dart striking an innocent bystander, with the potential maiming and/or catastrophic consequences ensuing. See the journal article *The Taser Weapon: A New Emergency Medicine Problem* by Eric M. Koscove, M. D., Annals of Emergency Medicine, Vol. 14, December, 1985.

Third, these angling darts could not pass down the bore of most conventional firearms. Conventional firearms are generally far less fragile than the plastic TASER and dual use of the firearms would reduce an equipment expenditure for financially stressed municipalities and government agencies. Moreover, if the TASER cartridges could be fired from conventional firearms, this would allow the individual deploying the firearm, the option of deploying it with less than lethal results, for example, in peace keeping operations involving civil unrest. Military and law enforcement personnel have little extra unused space in their vehicles or on their persons to carry separate nonlethal weapons. In the event of a failed TASER firing and an escalating threat, lethal force could be immediately deployed. Additionally, considering the varying sizes and shapes of the sundry animals that might require capture for various reasons, a weapon expelling such spreading projectiles would be difficult to deploy and otherwise impractical for animal control and for the live capture of animals.

Over thirty-five percent of the United States households have firearms. Twenty-seven percent have shotguns. These homes contain 192 million firearms. Sixty-five million are handguns. Twenty-eight million are semi-automatic weapons. Forty-nine million are shotguns. Fifty-four percent of these owners admitted that their firearms were kept unlocked. Twenty percent of the owners admitted that their firearms were kept unlocked and loaded. Hundreds of children have actually died in accidental shooting deaths over the past few years, with many more injured. Forty-six percent of owners stated that they obtained the firearms to protect themselves against criminals.

If these firearms were loaded exclusively with ammunition which fired or launched only a low velocity projectile containing a pair of electrical contacts, accidental infant shootings and deaths could be greatly reduced or even eliminated.

If the contacts were also part of the previously described weapon for immobilization and capture, the firearms could still be effectively used to protect their owners against criminals. Owners are disinclined to lock firearms, because of the time delay encountered when unlocking the firearms in the face of an imminent threat of serious bodily injury.

If the wires are not deployed to their maximum range and length, they will hang from the cartridge over the bottom of the port or firing bay and frequently rest laxly on the ground in close proximity to each other or even resting upon or overlapping each other for portions of their lengths. Accordingly, each single conductor wire must be insulated from the other to prevent the TASER's arcing output current from shorting between the wires before the circuit is completed through the target. However, even if the walls on the paired conductors together provide sufficient insulation against an output arc between the conductors, the described method of dart delivery brings the wires within millimeters of one of the cartridges' port contacts. The necessarily uninsulated contacts, which are within the TASER's rectangular ports and which connect the cartridge wires to the poles of the power supply, are spaced at a near maximum distance within the ports, so the arc at the target can travel as long a distance as the weapon design can allow. This proximity between an uninsulated contact and an opposing wire results in frequent electrical shorts between the contact and the wire and a loss of electrical power at the target.

This problem is exacerbated and other problems are created owing to the fact that it is commercially impractical to more than marginally insulate against the TASER output potentials, which typically exceed 50 KV, if the TASER is to remain a hand held and easily concealable device.

In an effort to maintain the low force factors considered necessary for a concealable weapon delivery system which is presumed incapable of seriously injuring a human target, but which is also capable of propelling a projectile at a target for a practical range, it is desirable to use a small propellant charge and a light weight projectile with trailing conductors which are strong enough not to be broken by the launching force but are of small volume. For example, TASERs as currently manufactured, project two barbed fletchettes weighing 1.4 grams each toward a target at a muzzle velocity of 200 fps by the force of the explosion of ⅘ths grain of smokeless powder propellant. One 36 AWG copperweld conductor with a 4 mil diameter trails each flechette. The flechettes, trailing with uninsulated 30 AWG single conductor magnet wire, can travel over 15 feet to a target with ample force remaining to contact in the target. Yet, the flechettes will not generally impact at a velocity that will allow their main body to penetrate human skin, that is 125 to 170 fps. (See United States Consumer Product Safety Commission internal memo, dated received Nov. 7, 1975, addressed to Tom Mackay from Jeanette Michael, and citing B.A.T.F. correspondence which sites standards established by the Office of the Surgeon General, U.S. Department of Army).

Therefore, an additional consideration when insulating the wires trailing the TASER flechettes is that the insulation does not, because of its additional weight or rigidity, significantly reduce the range or impact velocity of the flechettes. The insulated wire must also remain compact enough for dozens of feet of the wire to be stored in the cartridges of a small concealable weapon and, hopefully, while maintaining a firearm'classification for the weapon that is economic to market. (See generally weapons classifications, excise tax requirements, and record keeping and paperwork requirements in the *Omnibus Crime Control and Safe Streets Act of* 1968, codified as amended by Titles 1 and 2 of the *Gun Control Act of* 1968, P.L. 90–618 as 18 *USC* 921–928 and 18 C.F.R.178.11–178.129 and 18 C.F.R. 179.11–179.163).

High grade dielectrics which are commercially feasible and otherwise practical for extrusion on the TASER's wire conductor, like Tefzel, are available with maximum dielectric strengths of about 2000 volts/mil and a dielectric rating of 2.7. The ASA defines the dielectric strength of a material as the maximum potential gradient that the material can withstand without rupture. However, when Tefzel is extruded with adequate wall thickness to have a dielectric strength of 50 KV, that is a 25 mil wall of insulation or a 54 mil O.D. wire, the wire insulation becomes much too rigid and heavy and creates a drag which greatly reduces both the TASER flechettes range and impact velocity when propelled by explosion of ⅘ grain of smokeless powder. Moreover, the wire is far too voluminous to be stored in the TASER cartridges. The TASER cartridges can only each store a total of 32 linear feet of single conductor wire with an overall diameter of 20 mils.

Accordingly, these dielectrics must be extruded on the conductors with total wall thicknesses between the wires that will only marginally protect against arcing shorts between the trailing conductors and then only with air gaps and the TASER's short application times considered. Typically, the TASER wires have insulative walls of Tefzel that range in thickness from 6.5 mils to 8 mils or ratings of 13 KV to 16 KV dielectric strength. The two insulative walls on the wires and any air gap between the wires would provide the total resistance to current conduction between the wires or a minimum dielectric strength rating between the wires of only 26 KV to 32 KV, assuming no air gap between the wires. The weapon and cartridge casings are made of insulative plastics to prevent the 50 KV output current from shorting through the weapon's operator. However, even high impact plastic casings with thicknesses accommodating hand held portability cannot contain considerably more significant pyrotechnic explosions for launching the flechettes and wires.

Because the insulative wall on a single conductor is clearly not rated to insulate against the TASER output potentials, shorts easily occur between an opposing wire and an uninsulated port plate even with maximum wire extensions. Moreover, if the circuit similarly opens at the target or arcs through a higher air impedance at the target, shorts may occur between the wires and prior to the output currents reaching the intended target. Also wire flaws such as the conductor deviating within the insulation as the result of manufacturing equipment, can reduce insulative wall thickness and/or encourage corona build ups between the insulator and conductor and result in shorts between the wire's even if the impedance at the targets does not necessarily exceed the wires insulative ratings. The circuit can intermittently open at the target, for example if a target with baggy clothing is writhing about on the ground. However, if the wiring permanently breaks down or ruptures and shorts at the bay, to ground, or otherwise between the wires when the circuit first opens at the target or first arcs through a higher impedance at the target, the power output at the target may cease permanently.

Further, because of the phenomenon of arc tracking, surface arcs especially with conductive carbon build ups from repeated firings can foul the TASER ports, which in current manufacture have been made of insulative and high impact plastics like ABS and Noryl and may short the output current from the supply before it reaches the target.

It would therefore be highly desirable to create a weapon for immobilization and capture wherein the connection of the opposing poles of a power supply to a remote target is by means of a single projectile or missile. Such a weapon projectile could a) launch or separate at or proximate to the target into a second missile or projectile containing a supply contact which is electrically opposed to the contact remaining in the launching or other separated missile or projectile and b) which is connected to the opposing poles of the weapon power supply by means of a pair of insulated trailing conductors exiting the projectile/missile or launcher at a fixed distance from each other and not designed to separate from each other at a fixed angle. This would greatly improve the TASER's effective range. The desirable contact point spread could then be achieved at or near the target and the weapon's range becomes theoretically unlimited.

SUMMARY OF THE INVENTION

The maximum range of the present invention is limited only by the maintenance of projectile force factors that are not injurious to the target at close range. Operational embodiments of single supply connected projectiles, which are constructed to launch or separate into a second projectile and which exit launching tubes with little force and, yet, travel over twice the maximum range of the TASER as currently manufactured, have already been constructed and successfully deployed against human targets. For example, operating embodiments of such single projectiles weighing 0.06 kg that are 85 millimeters long with a 51.85 millimeter diameter and with 4 one centimeter long darts mounted on its target seating face have been successfully launched. Such launch is implemented by explosion of one grain of Federal 209A shotgun primer ignited Goex FFFFg black powder at a muzzle exit velocity of only 33.52 m/s (110 fps) and contact and affix to a target over 35 feet away from the launcher. There was no separation of the projectile's two trailing wires which consist of single conductors of 36 AWG copperweld contained within a 8 mil wall of tefzel, from the launcher or projectile. This would give the projectile an impact force where it exits the launching tube of only 2.011=0.06×33.52 or 2.011 newton. Accordingly, it seems likely that with adjustment of such factors as propellant charge, wire O.D., and projectile weight, maximum ranges well over 35 feet can be easily achieved. The launching cartridge, containing the black powder, was loaded into a standard Orion 12 gauge signal flare launcher with a plastic barrel and an attached 23 centimeter long launching tube constructed of standard 2" (52 millimeter) PVC, 1" ABS plastic water pipe, and adhesives. The signal gun and launcher discharged 170 projectiles in succession by explosions of one grain of black powder ignited by a Federal 209A shotgun primer without any fractures of the plastics of the signal gun or launcher visible at 250× magnification. Wire connection, as a design feature considered by itself in isolation, should not provide a practical impediment to increased projectile range. Wire guided missiles have maximum ranges up to 3,000 meters or 9,800 feet and are only limited by the range of human sight. However, when considered along with safe force and other force factors, wiring may effect the projectile's ultimate minimum range, but not likely within ranges of 0.0762 meters to 22.86 meters or ranges of 3" to 75'.

Minimum range is now limited only by the maintenance of force factors that are not injurious to the target and the length of the projectile that is exiting the launch tube. The projectile must be large enough to prevent the supply's high voltage output arc from shorting at the projectile rather than through the maximum possible impedance at the target that the weapon's other design factors will allow. The earlier described projectile with a length or 85 millimeters of approximately 3" and a diameter of 51.85 millimeters or 2", is large enough to prevent such arcing at the projectile. With the adjustment of the supply's output voltage or shunt, this projectile length and diameter could easily be reduced to lengths of <80 millimeters with diameters <38 millimeters. This would allow the entire weapon to be loaded as fixed ammunition from many conventional weapons such as the 38 millimeter Federal Model 203 A Gas Gun and the 40 millimeter Colt M203 grenade launcher which attaches directly to a Colt M16A1 or any M16A2 rifle or carbine. Accordingly, weapon systems of the improved design can be constructed with minimum ranges of approximately 3".

The main projectile of the invention can be made to launch a second projectile at or near the target by a number of novel, simple, and inexpensive alternatives as follows:

a) The continued momentum of a second projectile after a launching projectile strikes the target. With this method, it is desirable, but not essential, that the second projectile exits upwardly from the ground via a launching projectile bore that is along and at an angle to any diameter of the launching projectile. With such an embodiment, the influence of gravity on the second projectile is employed to create a contacting arc trajectory, rather than a potentially dart deflecting trajectory. This method would eliminate the possibility of carbon tracking or other shorts occurring in the point bore. It also allows the high voltage output to be activated before the projectile exits the cup or while it is in flight.

b) Another method is to expel the second projectile at or near the target via a pyrotechnic device designed or modified to be ignited by the power supply's high voltage output completing a circuit and then opening to allow the output to complete through a more resistive target circuit. The launching projectile can be used as a remote self activated firearm which discharges the second projectile at or near the intended target. With the high voltage supply circuit activated prior to its exit from the launcher or while in flight, the high voltage arc could complete through the target from supply output contacts on the launching projectile face if the contacts were sufficiently spaced to prevent arcing through atmosphere without the target path, but insufficiently spaced to insure disabling the target. As the projectile approached the target, the arc would complete through the target and ignite a pyrotechnic, such as a modified primer or a squib, contained in an angled launching projectile bore that is similar to the launching projectile bore described in paragraph a) above. This would expel the second projectile from the bore while at the same time opening the initial supply circuit path and allowing the circuit to complete through the wider and more resistive path now existing through the second projectile. This would effectively allow the supply output to "sense" the target from up to several inches away and automatically ignite the projectile firearm. As the second projectile could be released from the launching projectile several inches away from the target, larger projectile spreads and, consequently, supply circuit paths could also be achieved at the target.

c) A delay switch, with a time delay sufficiently short to prevent human extraction of the affixed launching projectile from the target before the high voltage output is activated, but of sufficient length to delay the high voltage activation, pyrotechnic ignition, and the second projectile's exit from the angled launching bore until the launching projectile was in contact with the target might also be used. This delay would also prevent the static attraction of the fine wires from twisting them while in flight and risking shorts because of the inadequate insulation walls on the wires. The second projectile could also be released by the force of opposing permanent and/or electromagnets or spring released. The springs might be triggered electronically or electromechanically. This would also eliminate the possibility of any carbon tracking shorts arising across the cartridge surface. The circuit might also be activated by a motion detector attached to the discharger cup.

The improved weapon for immobilization and capture of the present invention provides a larger projectile which also permits connection of the projectile to the target by non-invasive means such as adhesives rather than potentially skin penetrating darts. This would render injury to the target or innocent bystanders, such as eye injury, far less likely as the launched dart is tethered closely, in practice with only two and one half foot of wire on operational embodiments tested to date, to the target affixed launching projectile. Also, the larger projectile permits rocket propulsion, which has the potential of reducing the force required at the launcher for expulsion of the projectile to the target, thereby, reducing the possibility of the supply connecting wires snapping as the missile escapes the launcher muzzle. This might also permit force factors to be lowered sufficiently for the circuit to be contained entirely in the missile and wiring to a remote supply completely eliminated. Further, the force of impact of the larger projectiles acts to destabilize the target accelerating and enhancing the electronic outputs disabling effects. The limited 2½' tether on the launched dart is sufficiently short to allow both darts to contact and affix to a wide variety of domestic animals and immobilize them given properly calculated exit angle, pulse repetition rate, and power. Moreover, with the limited tether separating at the target, the separating dart is not likely to angle off and miss the target if the launching portion of the weapon is cocked to the right or left when fired. Moreover, as the entire supply connection is expelled from the firing port, carbon build up in the port can no longer result in track shorting of the output arc.

The weapon system of the present invention, including the projectile, may be loaded as fixed ammunition and the projectile discharged through the barrel of conventional weapons. The projectiles may also be launched from electrically insulative launching tubes or discharger cups (often and inaccurately referred to as "grenade launchers"), which could be fitted onto the barrel terminations of a variety of conventional devices, such as shotguns, rifles, pistols, grenade launchers, flare and other signal guns, and air and other gas guns (with paint ball guns particularly suited to this purpose). The launching force would be provided by the expansion of gases from, for example, the discharge of a launching cartridge loaded into a shotgun, pistol, grenade launcher, or flare gun. The discharger cups might be of single use disposable construction or reusable devices similar to those discharger cups currently employed to launch explosive grenades and/or CS canisters from firearms like shotguns and pistols. The reusable devices would have the advantage of being able to launch other less lethal projectiles such as CS canisters and bean bags. Even if the various projectiles differed in caliber, with adapters similar to those already manufactured to adapt 38 mm canisters to 40 mm discharger cups, they could be fired from a single discharger cup. Both reusable and disposable discharger cups could be manufactured to allow the fire through of lethal ammunition to accommodate escalating threat. Interchangeable electrically insulative barrels might be manufactured to terminate into a discharger cup.

Configurations may be provided wherein one could greatly reduce the possibility of the previously described undesirable breakdowns or ruptures occurring in the insulation of an output wire and the subsequent shorting of the output current between the opposing wires or a wire and an opposing contact or ground. It is well understood in the literature that both arc discharges and insulative breakdowns are typically point discharge phenomenon highly dependent upon electrode geometry and the charge distribution on the electrode and which can be described in potential gradient distribution, watts/$cm^2$.

Therefore, if the trailing conductors could be configured as the plates of a capacitor and a large enough capacitance created in parallel with the secondary winding of the supply's output transformer, the output charge could be so distributed on the conductors that the watts/$cm^2$ at tension points on the conductors and the likelihood of a field enhanced arc discharge or insulative breakdown between the opposing conductive plates could be greatly reduced. As stated above, the improved weapon's delivery system, with paired opposing conductors encased in high dielectric tefzel, exiting the launcher at a fixed distance from each other, and designed to not separate from each other at a constant angle, can be configured into a capacitor with proper spacing of the insulation encased opposing conductor plates from each other. Various plate areas, geometries, dielectrics, dielectric thicknesses, and therefore capacitances might be selected. For example, a single dual conductor wire might connect the supply to the projectile. The conductors could be separated from each other with a single wall of Tefzel that is 16 mil thick (a dielectric strength of 32 KV). If ribbon conductors 12.5 mil wide and 50 feet long were used, this would create a capacitance of 285 pf, according to C=(0.225 KA)/s, 285 pf=(0.225×2.7(constant for tefzel)×7.5 sq. Inches (area of one ribbon plate)/0.016 inches (spacing between plates). This would result in a storage and plate distribution capacity of 0.36 joules of energy at 50 KV applied, according to $E_n(CE^2)/2$, 0.36=(0.000000000285×2,500,000,000)/2. Such wire capacitors could be easily stored in a small concealable weapon on cylindrical windings similar to the common fabrication configuration of Mylar foil capacitors. In fact much longer and wider wire capacitors could be stored in the weapon. Lengths of 500 feet of widths of 2 inches are conceivable. Other materials or composites, such as mylar with a dielectric rating of 2.4 and a dielectric strength of 5 KV/mil, might be substituted as the capacitor dielectric or evacuation might create a practical vacuum dielectric. These capacitors might be encased in other high dielectric and high abrasion insulators. Any unextended wire remaining wound in the weapon would still act as a capacitance. Plate(s) and additional dielectric might be added between a conductor and the projectile and/or launcher where the conductor and the projectile and/or launcher connect to increase the capacitance. Even a capacitance with a very small storage capacity, much lower than the anticipated circuit output of 0.3 to 1 joule per pulse, could reduce the energy remaining at a point sufficiently to prevent avalanche and an undesired arc discharge or insulative breakdown. A minimum capacitance of 95 pf is required. This would result in a minimum storage and distribution capacity of about 0.025 joules or about 1% of the minimum anticipated energy of a TASER pulse at 50 KV applied. A minimum single plate area of 2.4 inches should exist for energy distribution purposes. If a Tefzel insulated cylindrical conductor were used, the capacitance, of course, might differ to an extent from the above calculations, but a reduction in the likelihood of edge point discharges should compensate.

If the impedance at the target is too great for arcing supply output to complete the circuit through the target, the circuit will complete through what is essentially a self discharging tank circuit. The tank circuit is preferably not in resonance, and not leaking rapidly through the capacitor's dielectric. Even an open without a subsequent insulative breakdown will stress the circuit. This can lead to output transformer breakdowns and other damage from collapsing high tension fields ringing back into circuit components. Of course, if the arcing output is initially or subsequently able to complete through the target, this capacitance either never significantly develops because it is shorted across the target or drains through the target and is no longer of any real significance in circuit operation. However, with the delivery system as described in the improved weapon, the power output of the weapon's supply must be modified. Operational embodiments of such dual conductor wires have already been constructed and successfully tested. A twenty-seven foot length of dual conductor wire with an 8 mil wall of Tefzel insulation between the conductors was constructed. The individual conductors were separated from each other for six inches along the length of wire at both ends. A 50 KV, 10 watt, 7 pps current at 1.43 joule per 4 micro second pulse was applied to the wire and a 4½ inch air gap. The circuit was activated in bursts of 5 seconds ON and 5 seconds OFF. As anticipated, a current was not observed to arc through the air gap. On 10 trials, insulation rupture did not occur for an average 21.2 seconds.

The same conductors, separated into two wires, were configured to only cross each other at a single point with 8 mils of Tefzel insulator between them. When power was applied through the wires and a 4½ inch gap under conditions otherwise identical with the above test, insulation rupture occurred in an average of only 20 milliseconds in 10 trials.

It has long been observed that certain materials that might otherwise be classified as extremely strong electrical insulators, will pass large electrical currents when they are moving at high frequency, especially when also at high voltage. An early description of this phenomenon can be found at pages 5–6 in Nikola Tesla's work, *Experiments with Alternate Currents of High Potential and High Frequency*, a lecture delivered before the Institution of Electrical Engineers, London, and published in book form by W. J. Johnson & Co., Ltd. In 1892. At pages 5–6, Mr. Tesla observes "here, once more, I attach these two plates of wire gauze to the terminals of the coil, I set them a distance apart, and I set the coil to work. You may see a small spark pass between the plates. I insert a thick plate of one of the best dielectrics between them, and instead of rendering altogether impossible, as we are used to expect, I aid the passage of discharge, which, as I insert the plate, merely changes in appearance and assumes the form of luminous streams." See generally, *Nikola Tesla, Colorado Spring Notes* 1899–1900, © 1978 by Nikola Tesla Museum, Beograd, Published by Nolit, Beograd, Yugoslavia.

The Tefzel, that is used to insulate the TASER® conductors, is a member of the Teflon family of materials (Ethylene Propylene Chlorinate Polymers) with an extra polyethylene molecule in part of the chain, which gives it better abrasion resistance qualities than some other Teflons. Experiments indicate that even when tefzel is extruded to thicknesses that at its dielectric rating should fully insulate against the TASER's 50 KV electrical output, large amounts of the supply output current will conduct through the tefzel and between the opposing conductors when they are placed in close proximity to each other. The TASER outputs pulses, which one might anticipate because they are generated at the primary by a 4 microsecond 1.5 KV to 2 KV D.C. saw tooth pulse, would be inverted dampened D.C. saw tooth pulses having peaks of approximately 50 KV and approximately 4 micro seconds in duration. The actual output wave observed, however, with ringing, takes the form of a dampened sinusoidal wave occurring at a rate, but not for a duration of several million cycles per second. The walls of Tefzel act as a current bleeding resistance and a power loss at the arcing terminations of the conductors is observed as a significant decrease in the penetrating arc.

Power loss is most significantly the result of conduction between the opposing wires that occurs through the Tefzel, rather than the result of linear resistance to current flow offered by the conductor itself. In fact, while they were not visible to the unaided human eye in daylight or even artificial room lighting, at night in an unlit room, very faint streamers and glows could be observed to conduct between the wires where they were interlaced and where the lace crossings began to diverge from each other. Practical increases in the Tefzel insulation thickness will not significantly decrease the undesired conduction and accompanying power loss at the arcing terminations.

This indicated that an increase in the output power at the secondary might overcome the loss of penetrating arc between the wire terminations and restore the output to a disabling power. A circuit with a power output of 50 KV, 10 pps, and 1.2 joules/pulse was fabricated. Fifty (50) foot lengths of wire were interlaced as described before. arcing current pulses of 1½" between the wires open terminations could easily and consistently be produced over 15 trials with a gap setting of 2" at the supply.

Therefore, it is important to establish a range of supply output power, which while sufficient to provide an adequately penetrating arc when the weapon's delivery wires are in close proximity to each other and extended for dozens upon dozens of feet, would not in an of itself be at a threshold that would induce ventricular fibrillation in a normally healthy person or cause them irreparable harm if the output were applied directly from the secondary of the output transformer without intervening wiring.

The power output range that will not cause ventricular fibrillation in a normally healthy person, but is sufficient to allow an adequately penetrating pulsating arc that will "freeze" the target to the circuit at wire ranges exceeding 15', is an average wattage between 12 and 20 watts at 1.2 to 2 joules/pulse.

The calculated effective current of the TASER as currently manufacture, is 10 ma, but the threshold for inducing ventricular fibrillation in a normally healthy adult human is between 70–100 ma.

OBJECTS OF THE INVENTION

It is therefore a principal object of the present invention to provide an improved immobilization weapon having maximum effective range of over seventeen feet.

It is another object of the invention to provide an improved immobilization weapon having a minimum effective range of three inches.

It is another object of the invention to provide an improved immobilization weapon wherein two connecters are substantially the same distance apart at the target irrespective of distance to the target.

It is another object of the invention to provide an improved immobilization weapon having a projectile configured for launch from a shotgun or otherwise lethal weapon.

It is still another object of the invention to provide an improved immobilization weapon having a projectile configured for launching a voltage application connecter at or near the target.

It is still another object of the invention to reduce the occurrence of tension ruptures in the insulation of the wires connecting the power supply to the voltage application connecters.

It is another object of the invention to produce an improved immobilization weapon having a projectile configured for launch from a variety of non-firearm devices.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which:

FIG. 1 is a conceptual illustration of the invention shown configured as a shotgun accessory;

FIG. 2 is a top view of the projectile of the invention;

FIG. 3 is a bottom view of the projectile of the invention,

FIG. 4 is a cutaway side view of the projectile;

FIG. 6 and 7 illustrate in sequence the terminal operation of the projectile; and FIG. 8 and 9 are partially cutaway views of two alternative embodiments of the combined projectile and casing of the invention.

DETAILED DESCRIPTION OF PREFERRED EMBODIMENTS

Figure 5:
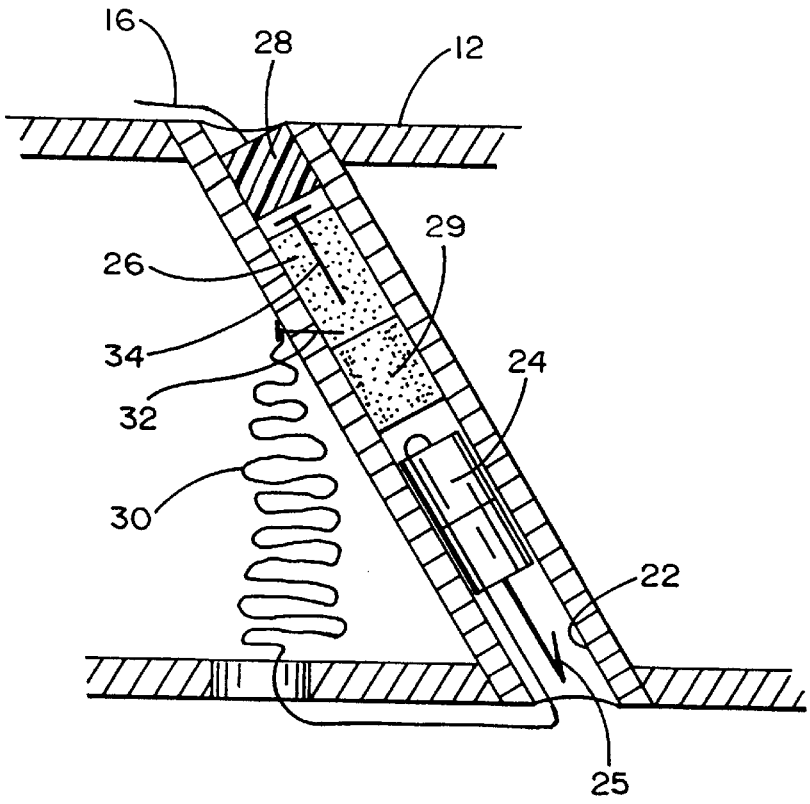
FIG. 5 is an enlarged cross-sectional view of the second connector launching assembly.

Referring now to the accompanying figures, it will be seen that a shotgun 10 is used to implement the preferred embodiment of the invention wherein a projectile 12 has been propelled from a discharge cup 14 from which the projectile is tethered by a pair of wires 16 and wherein the projectile has impacted a target 20 and has caused connectors 15 and 25 to contact and affix to the surface of the target 20. The distance between the discharge cup 14 and the projectile 12 is indicated to be thirty five feet, which may be deemed to be an exemplary figure of which the invention is capable as a minimum. Also shown in FIG. 1, is a pair of wires 18 extending from cup 14 toward the butt end of shotgun 10. Wires 18 may be connected to an external power supply (not shown) which may be used to provide primary source voltage to the invention. Such a power supply may be installed in the shotgun, such as in a compartment built into the shotgun butt or it may be otherwise supported by the structure of the shotgun or of the discharge cup 14. The nature of this circuit is not per se distinct from the disclosures of Cover and therefore need not be disclosed herein in detail. Also of special note in FIG. 1 is a wire tether 30 attached to connector 25 providing a selected separating distance between the two connectors 15 and 25.

As seen in FIGS. 2–5, the projectile 12 is preferably configured as a generally hollow cylinder having end caps 13 and 17, the latter having connector 15 extending longitudinally therefrom. A diagonal passage 22 extends between opposed radial surfaces of the projectile 12 through the center of the cylinder and terminating as openings in the radial surface of the projectile wall which may be seen best in FIGS. 2 and 3.

Passage 22 is covered with a Mylar tape 21 where it opens adjacent end cap 13. Tape 21 protects a primer 28 seen best in FIG. 5. As also seen in FIG. 5, within passage 22 there are positioned Styrofoam 26, foam wad 29 and connector body 24 terminating in connector 25, the point of which resides near the opening of passage 22 closer to end cap 17. A metal foil contact 19 projects from that opening to and over the end cap 17 terminating adjacent the front end of the projectile 12. Also positioned within passage 22 are pins 32 and 34. Pin 34 is positioned between primer 28 and Styrofoam 26 and extends through the Styrofoam toward pin 32. The latter pin is connected to wire tether 30 and which is, in turn, connected to the axial end of connector body 24.

Figure 6:
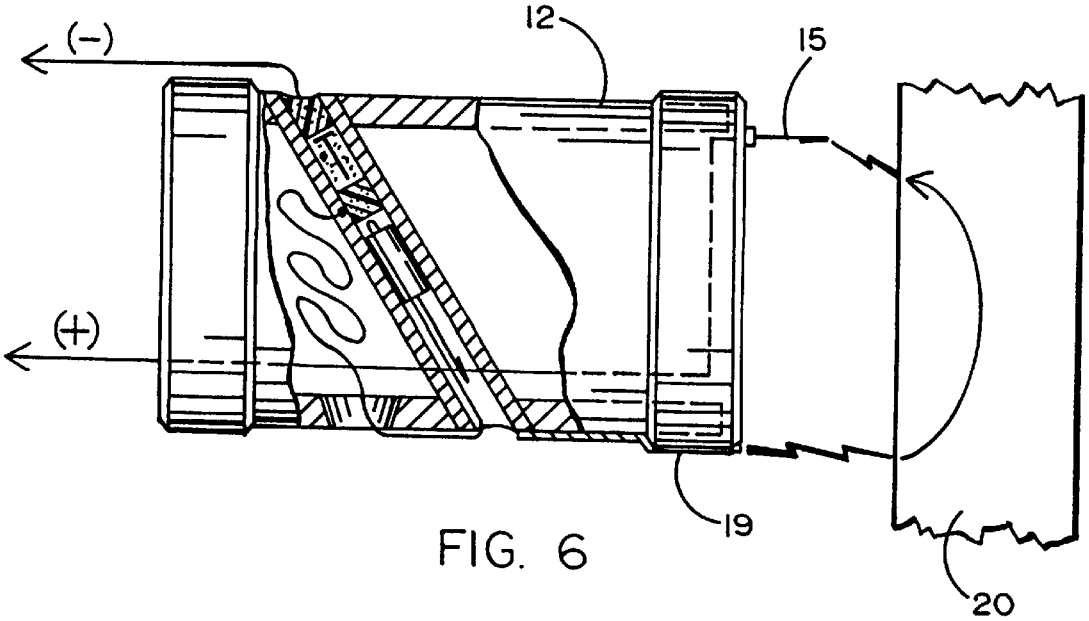

The terminal operation of the projectile 12 as it nears and engages the target 20, is illustrated sequentially in FIGS. 6 and 7. As shown in FIG. 6, when the projectile 12 and the connector 15 are near the target, (actual distance depends upon electrical parameters and ambient conditions), arcing occurs through the target between connector 15 and foil 19. The resulting current flow through the wires 16 and including the metal wall of passage 22, ignites the primer 28 and propels connector body 24 through passage 22 and on a generally diagonal path toward target 20 until connector 25 contacts and affixes to the target surface at a location spaced from the point that connector 15 also contacts and affixes to the target surface.

This secondary effect for propelling the second connector only when the projectile 12 is close to the target 20, assures that, irrespective of the distance to the target, the spacing between connectors 15 and 25 will be substantially the same. Moreover, the spacing will be within a preferred narrow range to virtually assure optimum disabling effect on the target.

In the preferred embodiment shown herein, the wire tether 30 is approximately eighteen inches long and the passage 22 is at an angle of approximately 70 degrees with respect to the axis of the projectile 12.

Figure 8:
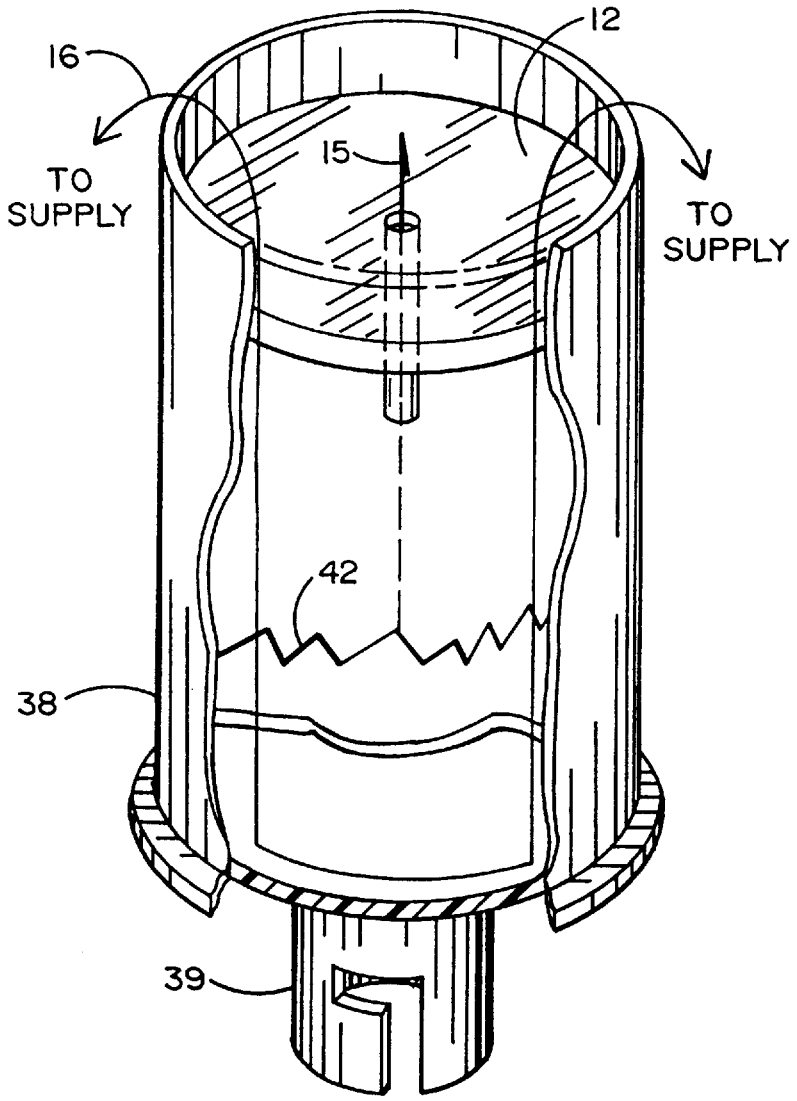

Two alternative configurations of the invention prior to activation and attachment to a shotgun are depicted in FIGS. 8 and 9. FIG. 8 illustrates an embodiment configured as a fixed ammunition shell which can be fired through a conventional 38 mm or 40 mm bore. FIG. 9 illustrates an embodiment for launching by gas expansion in the launching cartridge or casing in the chamber of a firearm. As shown in FIG. 8, projectile 12 is captured in a casing 38 adapted for connection to a shotgun by a shotgun barrel interface 39. A sabot 42 at the base of casing 38, below the projectile 12, provides a sealing mechanism to assure efficient gas expansion effect to launch projectile 12. In the embodiment of FIG. 9, the projectile 12 is fired from the shotgun and launched from casing 38 by operation of an igniting primer 35 and a propellant charge 36. The operation of primer and charge in the rifle or shotgun 10 is conventional and acts like a standard shell when it is desired to immobilize a target.

Having thus described a preferred embodiment of the invention which satisfies the aforementioned objects, it being understood that the disclosed apparatus is merely exemplary and not limiting.

What is claimed is:

1. An electrically-inducing immobilization weapon wherein at least one wire-tethered projectile is propelled along a path toward a live target to be immobilized; the weapon comprising:

a first connector on said projectile for attaching to the target at a first location;

second connector contained as part of said projectile for attaching to the target at a second location spaced from said first location; and said projectile also having a secondary propulsion device responsive to the position of said projectile relative to said target for actuating propulsion of said second connector when said projectile is substantially adjacent said target.

2. The weapon recited in claim 1 wherein said secondary propulsion device comprises a passage within said projectile, said passage being oriented for directing said second connector in a direction which is at a non-zero angle relative to the path of said projectile.

3. The weapon recited in claim 2 wherein said passage extends entirely through the projectile.

4. The weapon recited in claim 2 wherein said non-zero angle is greater than 45 degrees.

5. The weapon recited in claim 1 further comprising means for completing a circuit through said first connector and said target for conducting a current for actuating propulsion of said second connector.

6. The weapon recited in claim 5 wherein said means for completing a circuit comprises a conductive material forming said passage and a conductive material positioned along said projectile between said passage and an end of said projectile from which said first connector extends.

7. The weapon recited in claim 5 further comprising a primer in said passage adjacent said second connector and responsive to said current for propelling said second connector out of said passage.

8. The weapon recited in claim 1 further comprising a casing for receiving said projectile before said projectile is propelled toward said target.

9. The weapon recited in claim 8 further comprising means on said casing for attachment to a rifle.

10. The weapon recited in claim 9 wherein said rifle is a shotgun.

11. The weapon recited in claim 1 wherein the spacing between said first and second connectors on said target is substantially constant for any length of said path.

12. An immobilization weapon for impressing a high voltage across spaced points on a live target toward which a projectile is launched; the weapon comprising:

a first connector extending from said projectile for contacting the target at a first location;

a second connector contained within said projectile for contacting the target at a second location spaced from said first location; and a secondary propulsion device responsive to the position of said projectile relative to said target for actuating separation of said second connector from said projectile when said projectile is substantially adjacent said target.

13. The weapon recited in claim 12 wherein said secondary propulsion device comprises a passage within said projectile, said passage being oriented for directing said second connector in a direction which is at a non-zero angle relative to the path of said projectile.

14. The weapon recited in claim 13 wherein said passage extends entirely through the projectile.

15. The weapon recited in claim 13 wherein said non-zero angle is greater than 45 degrees.

16. The weapon recited in claim 12 further comprising means for completing a circuit through said first connector and said target for conducting a current for actuating propulsion of said second connector.

17. The weapon recited in claim 16 wherein said means for completing a circuit comprises a conductive material forming said passage and a conductive material positioned along said projectile between said passage an end of said projectile from which said first connector extends.

18. The weapon recited in claim 16 further comprising a primer in said passage adjacent said second connector and responsive to said current for propelling said second connector out of said passage.

19. The weapon recited in claim 12 further comprising a casing for receiving said projectile before said projectile is propelled toward said target.

20. The weapon recited in claim 19 further comprising means on said casing for attachment to a rifle.

21. The weapon recited in claim 20 wherein said rifle is a shotgun.

22. The weapon recited in claim 12 wherein the spacing between said first and second connectors on said target is substantially constant for any length of said path.

23. The weapon recited in claim 12 further comprising a wire tether attached to said first and second connectors for applying said high voltage to said connectors from a location remote from said target.

* * * * *